US011512496B2

(12) United States Patent
Hyun

(10) Patent No.: US 11,512,496 B2
(45) Date of Patent: Nov. 29, 2022

(54) PROTECTING A CARD KEY FOR VEHICLES FROM BREAKAGE

(71) Applicant: HONDA MOTOR CO., LTD., Tokyo (JP)

(72) Inventor: YoungJin Hyun, Singapore (SG)

(73) Assignee: Honda Motor Co., Ltd., Tokyo (JP)

( * ) Notice: Subject to any disclaimer, the term of this patent is extended or adjusted under 35 U.S.C. 154(b) by 87 days.

(21) Appl. No.: 16/764,441

(22) PCT Filed: Nov. 23, 2018

(86) PCT No.: PCT/IB2018/001349
§ 371 (c)(1),
(2) Date: May 15, 2020

(87) PCT Pub. No.: WO2019/102263
PCT Pub. Date: May 31, 2019

(65) Prior Publication Data

US 2020/0362591 A1 Nov. 19, 2020

(30) Foreign Application Priority Data

Nov. 23, 2017 (KR) ..... 10-2017-0157413

(51) Int. Cl.
*E05B 19/00* (2006.01)
*E05B 35/00* (2006.01)
*G07C 9/00* (2020.01)

(52) U.S. Cl.
CPC ..... *E05B 19/0082* (2013.01); *E05B 19/0005* (2013.01); *E05B 35/007* (2013.01);
(Continued)

(58) Field of Classification Search
CPC ..... E05B 19/0005; E05B 19/0082; E05B 35/003; E05B 35/007; G07C 2009/00976; G07C 9/00944
See application file for complete search history.

(56) References Cited

U.S. PATENT DOCUMENTS 5,552,240 A 9/1996 Derstine
6,553,802 B1 * 4/2003 Jacob ..... E05B 19/0082 70/456 R
(Continued)

FOREIGN PATENT DOCUMENTS

CN 103198537 A 7/2013
CN 203774394 U 8/2014
(Continued)

OTHER PUBLICATIONS

International Search Report with Written Opinion of the International Searching Authority, dated Apr. 8, 2019, with respect to International Application No. PCT/IB2018/001349.
(Continued)

*Primary Examiner* — Christopher J Boswell
(74) *Attorney, Agent, or Firm* — Carrier Blackman & Associates, P.C.

(57) ABSTRACT

Disclosed is an invention that relates to a breakage prevention type card key. A breakage prevention type card key of the present invention includes: a substrate part installed inside a case part, a key accommodation part connected to the substrate part and having a groove into which an auxiliary key part is inserted, a locking part located inside the key accommodation part and elastically pressurizing a side surface of the auxiliary key part stored in the key accommodation part to restrain the movement of the auxiliary key part, and a reinforcement part extended from key accommodation part and coupled to the case part and augmenting the rigidity of the case part located on both sides of the entrance of the key accommodation part.

10 Claims, 8 Drawing Sheets

(52) U.S. Cl.
CPC ..... *G07C 9/00944* (2013.01); *G07C 2009/00976* (2013.01)

(56) References Cited

U.S. PATENT DOCUMENTS

| | | | | |
|---|---|---|---|---|
| 6,647,752 | B1 | 11/2003 | Chaillie | |
| 7,227,446 | B2 | 6/2007 | Kumazaki et al. | |
| 7,448,238 | B2 * | 11/2008 | Shimura | E05B 19/0082 70/252 |
| 7,664,470 | B2 * | 2/2010 | Sugimoto | E05B 19/0082 455/90.3 |
| 7,664,471 | B2 | 2/2010 | Sugimoto et al. | |
| 7,923,647 | B2 * | 4/2011 | Murakami | E05B 19/0082 174/564 |
| 8,009,410 | B2 * | 8/2011 | Goemmel | E05B 19/0082 70/399 |
| 8,061,170 | B2 | 11/2011 | Calor et al. | |
| 8,237,542 | B2 | 8/2012 | Katagiri | |
| 8,479,547 | B2 * | 7/2013 | Kataya | E05B 19/0082 70/456 R |
| 8,540,165 | B2 | 9/2013 | Foo et al. | |
| 8,953,331 | B2 | 2/2015 | Sugimoto et al. | |
| 8,976,535 | B2 | 3/2015 | Paek et al. | |
| 10,137,861 | B2 * | 11/2018 | Park | E05B 19/0082 |
| 10,994,699 | B2 * | 5/2021 | Hyun | E05B 19/0082 |
| 11,077,827 | B2 * | 8/2021 | Lee | E05B 19/0082 |
| 2003/0222755 | A1 | 12/2003 | Kemper et al. | |
| 2005/0136852 | A1 | 6/2005 | Nakagawa et al. | |
| 2006/0150696 | A1 | 7/2006 | Eychenne et al. | |
| 2007/0227866 | A1 | 10/2007 | Dimig | |
| 2009/0145187 | A1 | 6/2009 | Deppner et al. | |
| 2011/0313595 | A1 | 12/2011 | Kato | |
| 2012/0012659 | A1 | 1/2012 | Sugimoto et al. | |
| 2012/0092128 | A1 | 4/2012 | Yamane et al. | |
| 2014/0021025 | A1 | 1/2014 | Sersch | |
| 2014/0363716 | A1 | 12/2014 | Nishida et al. | |
| 2016/0191096 | A1 | 6/2016 | Kishimoto | |
| 2016/0250996 | A1 * | 9/2016 | Park | E05B 19/0082 701/2 |
| 2018/0302788 | A1 * | 10/2018 | Konchan | E05B 19/0082 |
| 2020/0296835 | A1 | 9/2020 | Hyun | |
| 2020/0357208 | A1 | 11/2020 | Hyun | |
| 2020/0362590 | A1 | 11/2020 | Hyun et al. | |
| 2020/0362591 | A1 | 11/2020 | Hyun | |

FOREIGN PATENT DOCUMENTS

| | | | |
|---|---|---|---|
| CN | 104080988 | A | 10/2014 |
| CN | 104466056 | A | 3/2015 |
| CN | 111492410 | B | 4/2022 |
| CN | 111630575 | B | 5/2022 |
| EP | 0987389 | A1 | 3/2000 |
| EP | 3056639 | A1 | 8/2016 |
| JP | 2001-250521 | A | 9/2001 |
| JP | 2004-131936 | A | 4/2004 |
| JP | 2007224664 | A | 9/2007 |
| JP | 2009-021106 | A | 1/2009 |
| KR | 2006-0113443 | A | 11/2006 |
| KR | 20120116563 | A | 10/2012 |
| KR | 20130066245 | A | 6/2013 |
| KR | 20140013393 | A | 2/2014 |
| KR | 101496321 | B1 | 2/2015 |
| KR | 20150031894 | A | 3/2015 |
| KR | 20150050682 | A | 5/2015 |
| KR | 101542857 | B1 | 8/2015 |
| KR | 20160139689 | A | 12/2016 |
| KR | 20170033204 | A | 3/2017 |
| WO | 2017135747 | A1 | 8/2017 |

OTHER PUBLICATIONS

Office Action dated May 10, 2022 issued in co-pending U.S. Appl. No. 16/764,416.

Office Action dated Apr. 22, 2022 issued in co-pending U.S. Appl. No. 16/764,458.

Office Action dated Sep. 20, 2022 issued over the corresponding Japanese National Phase Patent Application No. 2020-526938 with the English translation thereof.

* cited by examiner

PROTECTING A CARD KEY FOR VEHICLES FROM BREAKAGE

TECHNICAL FIELD

The present invention relates to a breakage prevention type card key, and more particularly, to a breakage prevention type card key capable of preventing the breakage of a product by augmenting the structural rigidity of a corner portion and a rim portion thereof.

BACKGROUND ART

In general, a card key for a vehicle is a device having a card-shaped housing part in which a transceiver, a substrate, a battery, and the like are mounted so that the storage thereof is easily achieved, and capable of remotely controlling the vehicle. A battery accommodation part is coupled to the inside of the housing part of the card key for a vehicle in the state in which the battery is mounted in the battery accommodation part.

Typically, as the thickness of a card key is decreased, the structural rigidity around a corner or a rim of the card key is reduced, thereby increasing the occurrence of the breakage of the card key. Therefore, there is a need for improvement.

The background technology of the present invention is disclosed in a Korean Patent Publication No. 2012-0116563 (registered on Oct. 23, 2012, the title of the invention: Smart key system, and vehicle controlling system and method thereof).

DISCLOSURE OF THE INVENTION

Technical Problem

The present invention has been derived in order to solve such a problem and an object of the present invention is to provide a breakage prevention type card key capable of preventing the breakage of a product by augmenting the structural rigidity of a corner portion and a rim portion thereof.

Technical Solution

A breakage prevention type card key according to the present invention includes: a substrate part installed inside a case part, a key accommodation part connected to the substrate part and having a groove into which an auxiliary key part is inserted, a locking part located inside the key accommodation part and elastically pressurizing a side surface of the auxiliary key part stored in the key accommodation part to restrain the movement of the auxiliary key part, and a reinforcement part extended from the key accommodation part and coupled to the case part and augmenting the rigidity of the case part located on both sides of the entrance of the key accommodation part.

In addition, the key accommodation part includes a cover part connected to the reinforcement part and having a space for accommodating the auxiliary key part, and a plate-shaped base part connected to the cover part and corresponding to the auxiliary key part.

In addition, the cover part includes a cover body installed at a position facing the auxiliary key part, a first extension part extended from the cover body and facing the locking part, and a second extension part extended from the cover body to a corner portion of the case part facing the key accommodation part.

In addition the locking part includes a movement protrusion part hooked to the inside of a connection hole part provided in the first extension part and hooked to a side surface of the auxiliary key part by a sliding operation, and an elastic member for elastically pressurizing the movement protrusion part.

In addition, the reinforcement part includes a first reinforcement member extended from the first extension part in a bent shape, and coupled to a rim portion of the case part facing the locking part.

In addition, the reinforcement part includes a second reinforcement member extended from the second extension part in a bent shape, and coupled to a corner portion of the case part facing the key accommodation part.

Advantageous Effects

A breakage prevention type card key according to the present invention may prevent the breakage of a case part since a first reinforcement member connected to a key accommodation part is coupled to a rim portion of the case part facing a locking part to augment structural rigidity.

In addition, according to the present invention, the breakage of the case part may be prevented since a second reinforcement part connected to the key accommodation part is coupled to a corner portion of the case part facing the locking part to augment the structural rigidity around the key accommodation part.

MODE OF IMPLEMENTATION OF THE INVENTION

Figure 1:
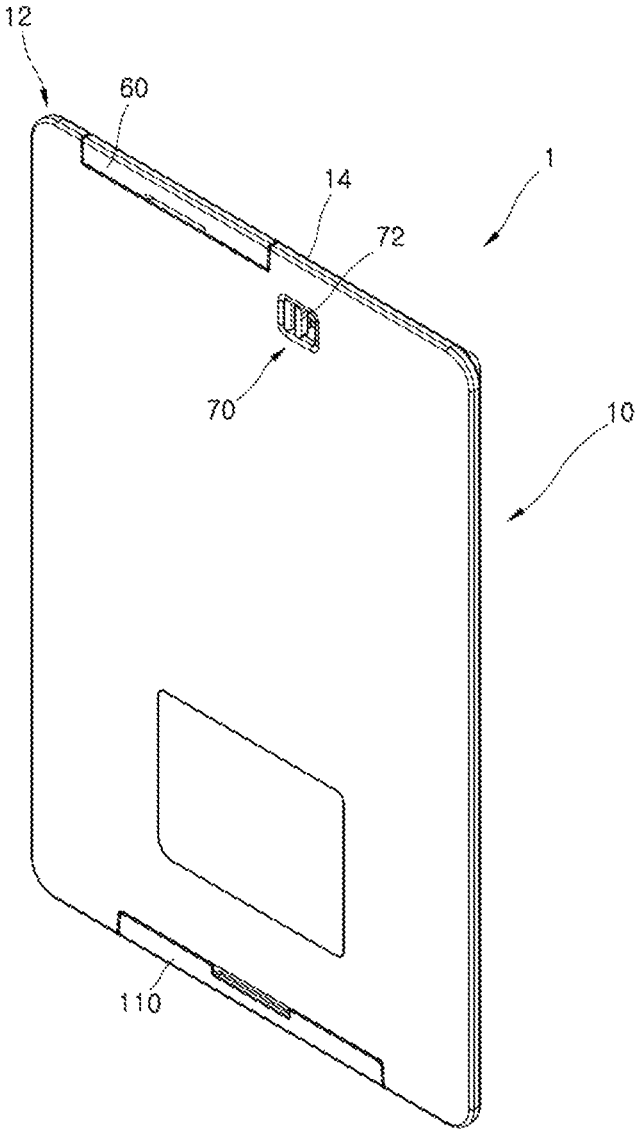
FIG. 1 is a perspective view schematically showing the structure of a breakage prevention type card key according to an embodiment of the present invention.

Hereinafter, a breakage prevention type card key according to an embodiment of the present invention will be described with reference to the accompanying drawings. In this context, the thickness of lines or the size of the components shown in the drawings may be exaggerated for the clarity and ease of understanding of the description.

In addition, the following terms are defined in consideration of the functions of the present invention, which may vary depending on the intention or practice of a user or an operator. Thus, definitions of the terms should be made based on the contents throughout this specification.

Figure 2:
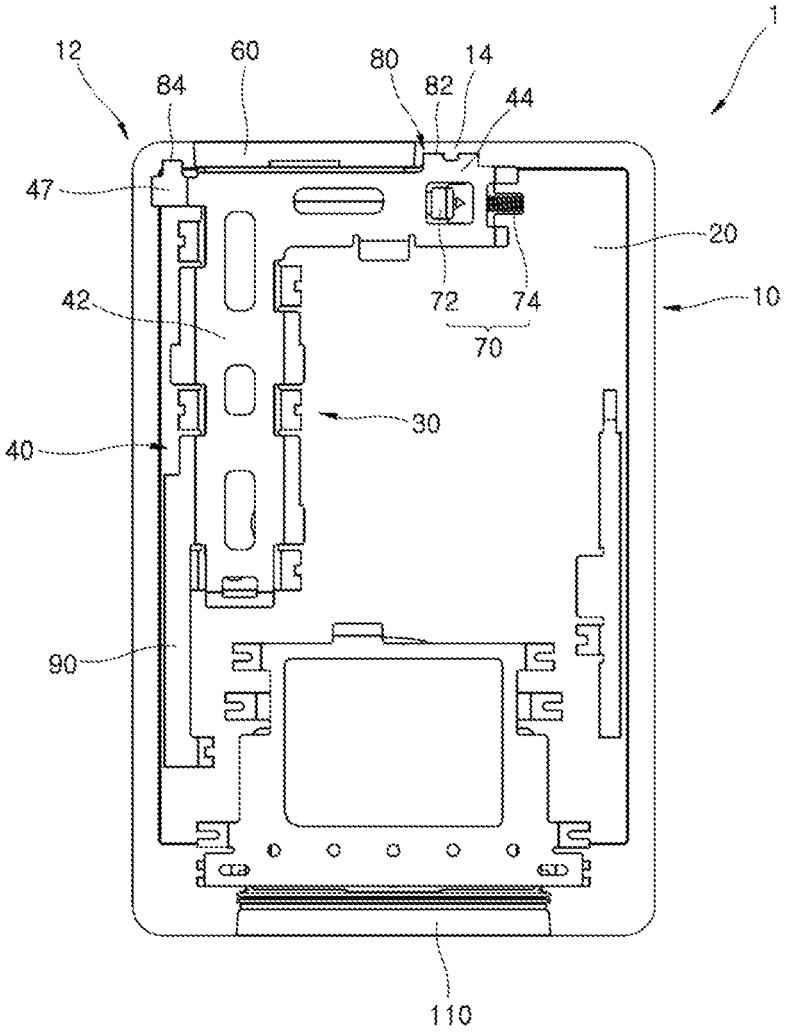
FIG. 2 is a view schematically showing a state in which a substrate part and a key accommodation part are installed according to an embodiment of the present invention.
Figure 3:
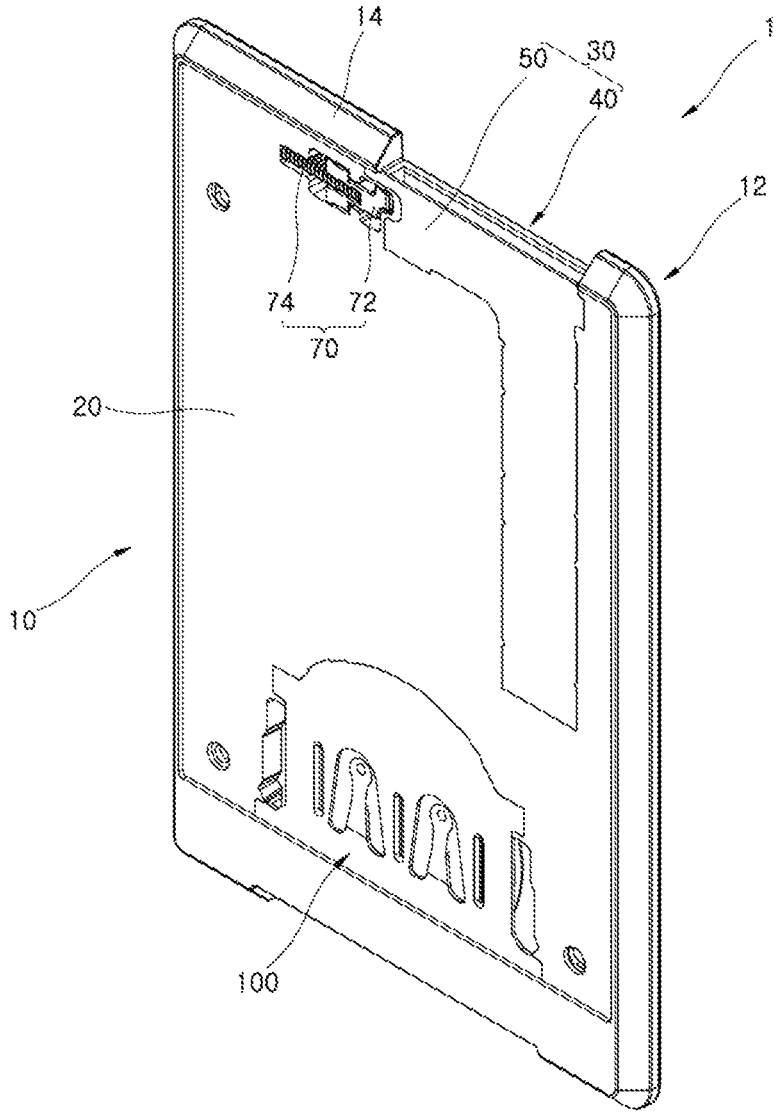
FIG. 3 is a view showing a state in which a key accommodation part is coupled to a case part according to an embodiment of the present invention.
Figure 4:
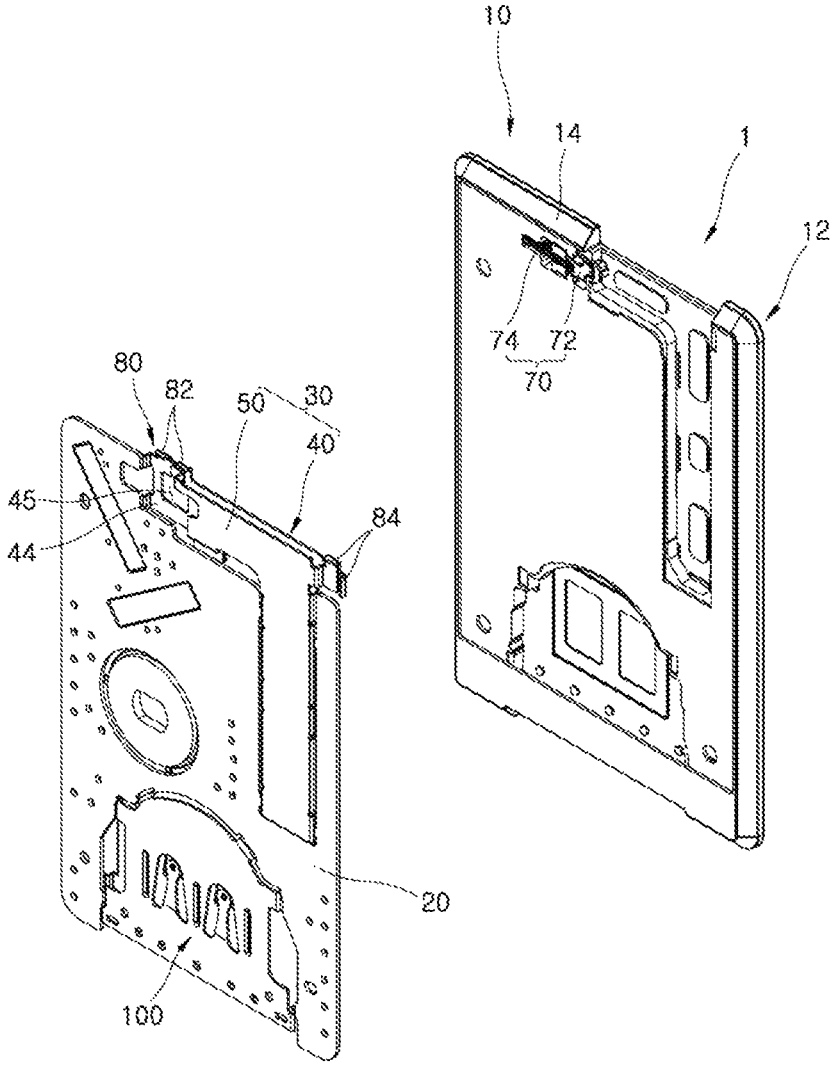
FIG. 4 is a view showing a state in which a key accommodation part is separated from a case part according to an embodiment of the present invention.
Figure 5:
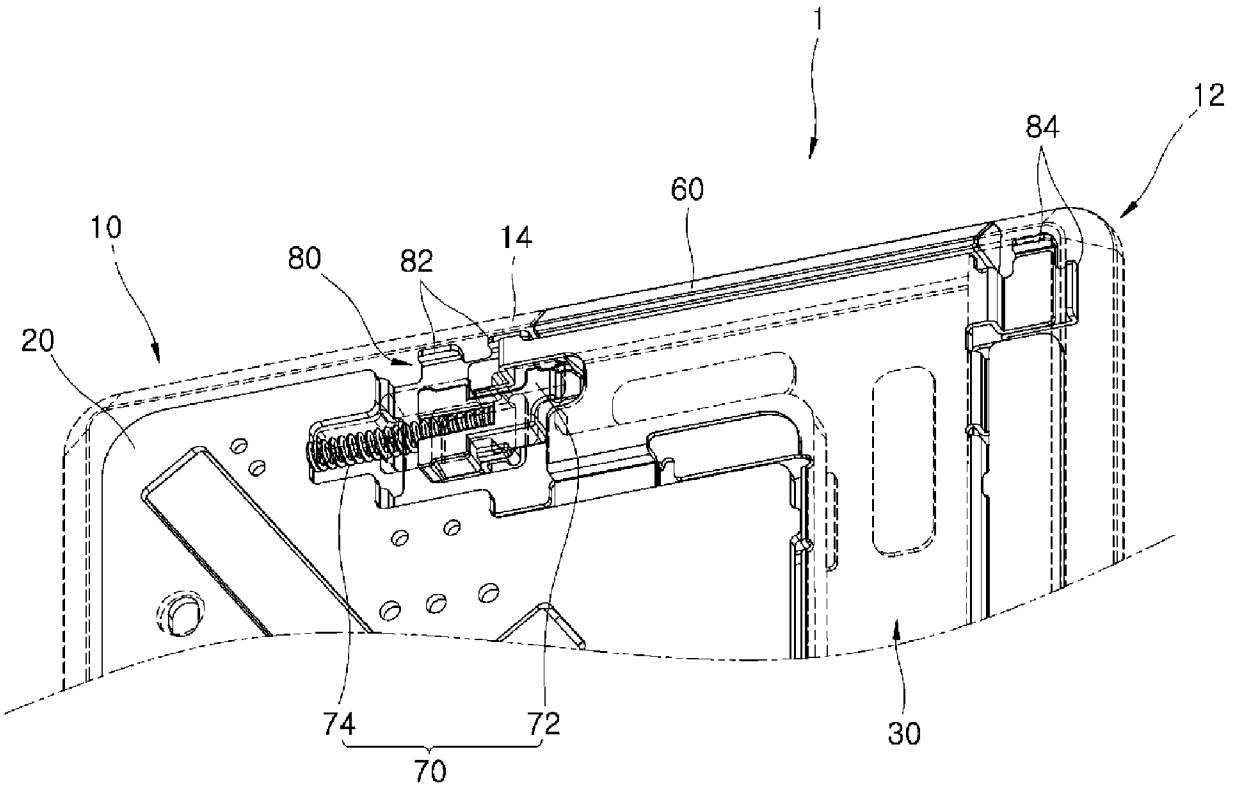
FIG. 5 is a perspective view showing a reinforcement part according to an embodiment of the present invention.
Figure 6:
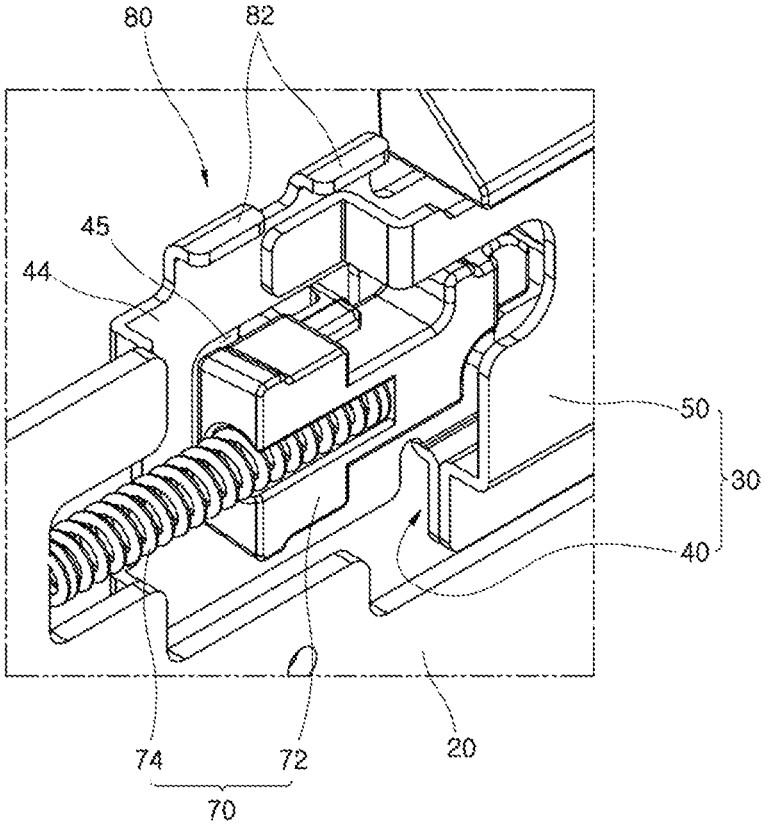
FIG. 6 is a perspective view showing a first reinforcement part according to an embodiment of the present invention.
Figure 7:
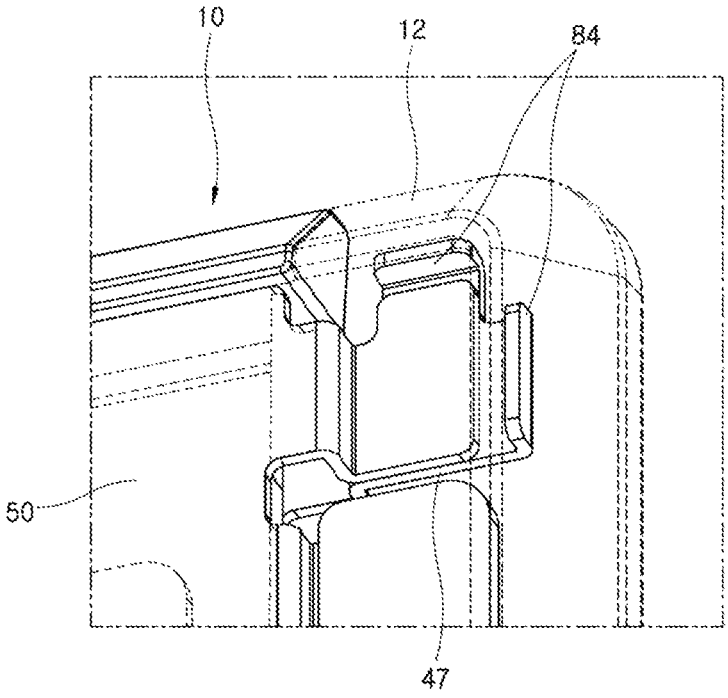
FIG. 7 is a perspective view showing a second reinforcement part according to an embodiment of the present invention.
Figure 8:
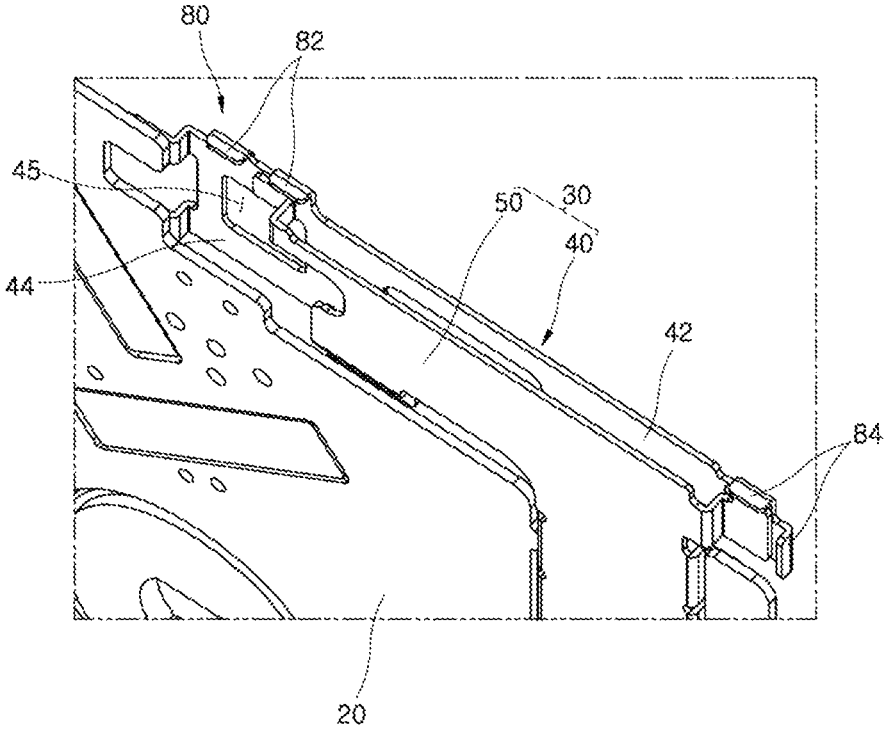
Figure 9:
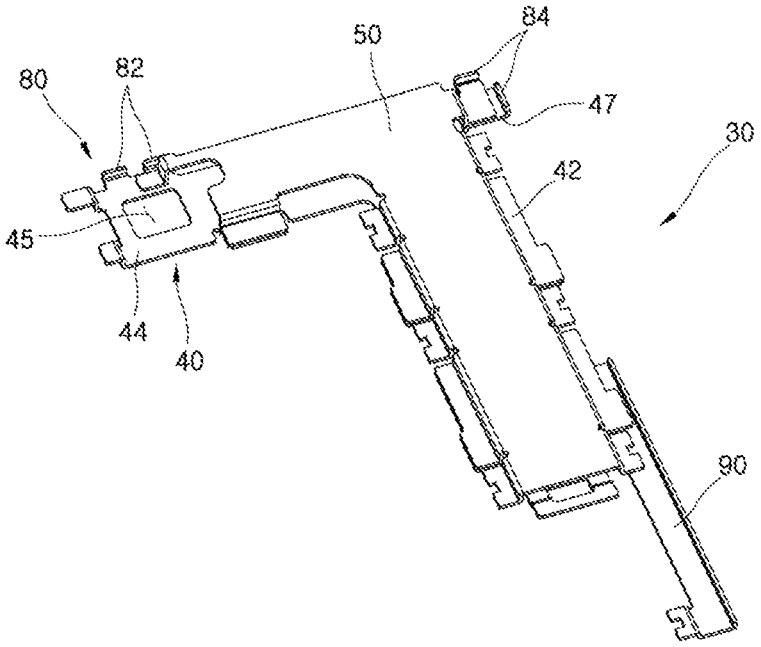
FIG. 9 is a perspective view showing a key accommodation part according to an embodiment of the present invention.
Figure 10:
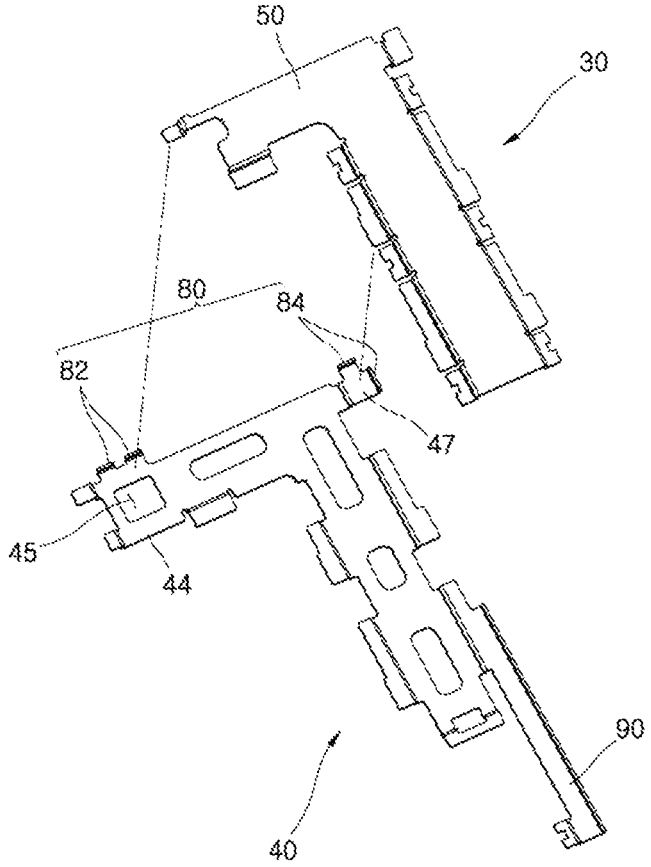
FIG. 10 is a perspective view showing a disassembled key accommodation part according to an embodiment of the present invention.

FIG. 1 is a perspective view schematically showing the structure of a breakage prevention type card key according to an embodiment of the present invention, and FIG. 2 is a view schematically showing a state in which a substrate part and a key accommodation part are installed according to an embodiment of the present invention. FIG. 3 is a view showing a state in which a key accommodation part is coupled to a case part according to an embodiment of the present invention, and FIG. 4 is a view showing a state in which a key accommodation part is separated from a case part according to an embodiment of the present invention. FIG. 5 is a perspective view showing a reinforcement part according to an embodiment of the present invention, and FIG. 6 is a perspective view showing a first reinforcement part according to an embodiment of the present invention. FIG. 7 is a perspective view showing a second reinforcement part according to an embodiment of the present invention, and FIG. 9 is a perspective view showing a key accommodation part according to an embodiment of the present invention. FIG. 10 is a perspective view showing a disassembled key accommodation part according to an embodiment of the present invention.

As shown in FIGS. 1 to 10, a breakage prevention type card key (1) according to the present invention includes a substrate part (20) installed inside a case part (10), a key accommodation part (30) connected to the substrate part (20) and having a groove into which an auxiliary key part (60) is inserted, a locking part (70) located inside the key accommodation part (30) and elastically pressurizing a side surface of the auxiliary key part (60) stored in the key accommodation part (30) to restrain the movement of the auxiliary key part (60), and a reinforcement part (80) extended from the key accommodation part (30) and coupled to the case part (10) and augmenting the rigidity of the case part (10) located on both sides of the entrance of the key accommodation part (30).

The substrate part (20) installed inside the case part (10) has components mounted thereon, and has a circuit for guiding electrical signals of the components formed thereon. The key accommodation part (30) is connected to the substrate part (20) and forms a space into which the key accommodation part (60) is inserted.

On the substrate part (20) according to an embodiment of the present invention, a groove is formed in a shape corresponding to the key accommodation part (30), and the key accommodation part (30) is inserted into the groove of the substrate part (20) and fixed. On the substrate part (20), an L-shaped groove is formed, and in the groove, the L-shaped key accommodation part (30) is installed.

On a lower side of the substrate part (20), a battery accommodation part (100) is formed, and into the battery accommodation part (100), a battery insertion part (110) may be inserted in a sliding manner. A battery is mounted on the battery insertion part (110) to supply power to the substrate part (20).

The case part (10) is made of a synthetic resin and is hardened in a shape surrounding the substrate part (20) and the key accommodation part (30). The substrate part (20) on which the key accommodation part (30), the reinforcement part (80), and a reinforcement extension part (90) is inserted into a mold and a resin-based liquid is hardened around the substrate part (20) in the mold to form the case part (10).

The key accommodation part (30) is connected to the substrate part (20), and forms a groove into which the auxiliary key part (60) is inserted. The key accommodation part (30) according to an embodiment includes a cover part (40) and a base part (50).

The cover part (40) is connected to the reinforcement part (80) and forms a space in which the auxiliary key part (60) is accommodated. The cover part (40) according to an embodiment includes a cover body (42) installed at a position facing the auxiliary key part (60), a first extension part (44) extended from the cover body (42) and facing the locking part (70), and a second extension part (47) extended from the first extension part (44) and the cover body (42) to a corner portion (12) of the case part (10) facing the key accommodation part (30).

The cover body (42) facing the base part (50) forms a space into which the auxiliary key part (60) is inserted. The L-shaped cover body (42) is provided with a plurality of separate holes for securing the fluidity of a resin and augmenting coupling force when the case part (10) is molded. The first extension part (44) extended from the cover body (42) is installed at a position facing the locking part (70), and inside the first extension part (44), a connection hole part (45) is provided.

Furthermore, the second extension part (47) located in a direction opposite to the first extension part (44) is extended from the cover body (42) and located inside the corner portion (12) of the case part (10), so that the structural rigidity of a rim portion (14) adjacent to the key accommodation part (30) is increased.

The base part (50) is connected to the cover part (40) and is formed in a plate shape corresponding to the auxiliary key part (60), that is L-shaped.

The auxiliary key part (60) is inserted into the key accommodation part (30) and stored, and is drawn out to the outside of the key accommodation part (30) when necessary. Since a groove part is formed on the side surface of the auxiliary key part (60) facing the locking part (70), a movement protrusion part (72) of the locking part (70) is inserted into the groove part provided on the side surface of the auxiliary key part (60) to restrain the movement of the auxiliary key part (60).

The locking part (70) is located inside the key accommodation part (30) and elastically pressurizes the side surface of the auxiliary key part (60) stored in the key accommodation part (30) to restrain the movement of the auxiliary key part (60). The locking part (70) according to an embodiment includes the movement protrusion part (72) hooked to the inside of the connection hole part (45) provided in the first extension part (44) and hooked to the side surface of the auxiliary key part (60) by a sliding operation, and an elastic member (74) for elastically pressurizing the movement protrusion part (72).

One side of the movement protrusion part is inserted into the connection hole part (45) of the first extension part (44) and is exposed to the outside of the case part (10). Therefore, a user may move the connection hole part (45) to unlock the locking part (70). The other side of the movement protrusion part (72) is located inside the key accommodation part (30) and installed to be slid toward the side surface of the auxiliary key part (60).

The movement protrusion part (72) is elastically supported by the elastic member (74) using a coil spring, and is moved toward the auxiliary key part (60) accommodated in the key accommodation part (30) or moved away from the auxiliary key part (60) by a user's operation.

The reinforcement part (80) is extended from the key accommodation part (30) and is coupled to the case part (10), and may be formed in various shapes in a technical sense to augment the rigidity of the case part (10) located on both sides of the entrance of the key accommodation part (30). The reinforcement part (80) according to an embodiment includes a first reinforcement member (82) and a second reinforcement member (84).

The first reinforcement member (82) is extended from the first extension part (44) in a bent shape, and coupled to the rim portion (14) of the case part (10) facing the locking part (70). The first reinforcement member (82) according to an embodiment is extended in a horizontal direction from an upper side of the first extension part (44), and inserted into the inside of the case part (10) to reinforce the structural rigidity of the case part (10). The first reinforcement member (82) is formed of a plurality of protrusions and forms protrusions in a shape bent from a rim of the first extension part (44).

The second reinforcement member (84) is extended from the second extension part (47) in a bent shape, and coupled to the corner portion (12) of the case part (10) facing the key accommodation part (30). The second reinforcement member (84) is extended toward the lateral direction respectively from an upper side and a side surface of the second extension part (47) of a rectangular plate shape, and inserted into the inside of the case part (10) to reinforce the structural rigidity of the case part (10). The second reinforcement member (84) is formed of a plurality of protrusions and forms protrusions in a shape bent from an upper side rim and a side surface rim of the second extension part (47).

The breakage prevention type card key (1) according to an embodiment of the present invention may further include the reinforcement extension part (90). The reinforcement extension part (90) is extended from the cover part (40) of the key accommodation part (30) and connected to the substrate part (20). The reinforcement extension part (90) extended in the vertical and longitudinal direction of the case part (10) has a rod shape, and is inserted into the inside of the case part (10) to improve the structural rigidity of the case part (10). The above reinforcement extension part (90) is connected to an antenna of the breakage prevention type card key (1) to improve the radio wave transmission/reception rate.

Hereinafter, the operation state of the breakage prevention type card key (1) according to an embodiment of the present invention will be described in detail with reference to the accompanying drawings.

The key accommodation part (30) and the battery accommodation part (100) are mounted on the substrate part (20) having components mounted thereon, and the reinforcement extension part (90) is installed on one side or on both edges of the substrate part (20). When the key accommodation part (30) and the reinforcement extension part (90) are mounted on the substrate part (20), the substrate part (20) is inserted into a mold and a resin-based liquid is injected into the inside of the mold to form the case part (10).

The case part (10) formed inside the mold covers the outside of the substrate part (20), the key accommodation part (30), and the reinforcement extension part (90) and is fixed. In particular, since the first reinforcement part (82) of the reinforcement part (80) is inserted into the inside of the rim part (14) of the case part (10) facing the locking part (70) and fixed, the structural rigidity of the rim part (14) is augmented.

Moreover, since the second reinforcement part (84) of the reinforcement part (80) is inserted into the inside of the corner part (12) of the case part (10) successively installed in the key accommodation part (30) and fixed, the structural rigidity of the corner part (12) is augmented.

Furthermore, since the reinforcement extension part (90) extended in the lateral direction from the cover part (40) is surface-mounted on the substrate part (20) in a state in which the reinforcement extension part (90) is in surface contact with the substrate part (20), the coupling force between the reinforcement extension part (90) and the substrate part (20) is augmented. In the breakage prevention type card key (1) according to an embodiment of the present invention, the reinforcement extension part (90) is coupled to the substrate part (20) to augment rigidity.

As described above, according to the present invention, since the first reinforcement member (82) connected to the key accommodation part (30) is coupled to the rim part (14) of the case part (10) facing the locking part (70) to augment structural rigidity, the breakage of the case part (10) may be prevented. In addition, since the second reinforcement member (84) connected to the key accommodation part (30) is coupled to the corner part (12) of the case part (10) facing the locking part (70) to augment the structural rigidity around the key accommodation part (30), the breakage of the case part (10) may be prevented.

Although the present invention has been described with reference to the embodiments illustrated in the drawings, this is merely exemplary. It will be understood by those skilled in the art that various modifications and equivalent embodiments thereto may be implemented. Accordingly, the true technical protection scope of the present invention should be determined by the following claims.

DESCRIPTION OF THE REFERENCE NUMERALS OR SYMBOLS

1: Breakage prevention type card key
10: Case part
12: Corner part
14: Rim part
20: Substrate part
30: Key accommodation part
40: Cover part
42: Cover body
44: First extension part
45: Connection hole part
47: Second extension part
50: Base part
60: Auxiliary key part
70: Locking part
72: Movement protrusion part
74: Elastic member
80: Reinforcement part
82: First reinforcement member
84: Second reinforcement member
90: Reinforcement extension part
100: Battery accommodation part
110: Battery insertion part

The invention claimed is:

1. A breakage prevention type card key comprising:

a substrate part installed inside a case part;

a key accommodation part connected to the substrate part and having a groove into which an auxiliary key part is inserted, the key accommodation part being separate and distinct from the case part, the substrate part including a groove into which the key accommodation part is inserted;

a locking part located inside the key accommodation part and elastically pressurizing a side surface of the auxiliary key part stored in the key accommodation part to restrain movement of the auxiliary key part; and a reinforcement part extended from the key accommodation part and coupled to the case part and augmenting rigidity of the case part located on both sides of an entrance of the key accommodation part, wherein the key accommodation part comprises: a cover part connected to the reinforcement part and having a space for accommodating the auxiliary key part, a base part is connected to the cover part and forms a plate member in a shape corresponding to the auxiliary key part, and the case part is made of resin in the shape surrounding the substrate part and the key accommodation part.

2. The breakage prevention type card key of claim 1, wherein the cover part comprises: a cover body installed at a position facing the auxiliary key part;

a first extension part extended from the cover body and facing the locking part; and a second extension part extended from the cover body to a corner portion of the case part facing the key accommodation part.

3. The breakage prevention type card key of claim 2, wherein the locking part comprises: a movement protrusion part hooked to an inside of a connection hole part provided in the first extension part and hooked to a side surface of the auxiliary key part by a sliding operation; and an elastic member for elastically pressurizing the movement protrusion part.

4. The breakage prevention type card key of claim 2, wherein the reinforcement part comprises a first reinforcement member extended from the first extension part in a bent shape, wherein the first reinforcement member is coupled to a rim portion of the case part facing the locking part.

5. The breakage prevention type card key of claim 2, wherein the reinforcement part comprises a second reinforcement member extended from the second extension part in a bent shape, wherein the second reinforcement member is coupled to a corner portion of the case part facing the key accommodation part.

6. The breakage prevention type card key of claim 2, wherein the cover body comprises a plurality of separate holes.

7. The breakage prevention type card key of claim 1, further comprising a reinforcement extension part, wherein the reinforcement extension part is extended from the cover part of the key accommodation part and connected to the substrate part.

8. The breakage prevention type card key of claim 1, wherein the key accommodation part includes the cover part and the base part, and the cover part and the base park are connected to each other to form the key accommodation part.

9. The breakage prevention type card key of claim 8, wherein the reinforcing part is formed integrally with the key accommodation part and augments rigidity of the case part located on both longitudinal ends of the groove formed in the key accommodation part.

10. The breakage prevention type card key of claim 1, wherein the reinforcing part is formed integrally with the key accommodation part and augments rigidity of the case part located on both longitudinal ends of the groove formed in the key accommodation part.

* * * * *